United States Patent [19]

Kakinuma et al.

[11] 4,112,858

[45] Sep. 12, 1978

[54] SEWING MACHINE WITH A PATTERN GENERATING DEVICE

[75] Inventors: Toshihide Kakinuma, Tokyo; Toshiaki Kume, Tachikawa; Hideaki Takenoya, Hachioji; Hachiro Makabe, Fussa; Kazuo Watanabe, Hachioji, all of Japan

[73] Assignee: Janome Sewing Machine Co., Ltd., Tokyo, Japan

[21] Appl. No.: 769,796

[22] Filed: Feb. 17, 1977

[30] Foreign Application Priority Data

Feb. 27, 1976 [JP] Japan ..... 51-20034

[51] Int. Cl.[2] ..... D05B 3/02

[52] U.S. Cl. ..... 112/158 E

[58] Field of Search ..... 112/158 E, 158 R, 158 A, 112/158 D; 74/54, 56

[56] References Cited

U.S. PATENT DOCUMENTS

| | | | |
|---|---|---|---|
| 2,924,107 | 2/1960 | Fresard et al. | 112/158 E X |
| 3,874,312 | 4/1975 | Cook et al. | 112/158 E X |
| 4,011,432 | 3/1977 | Skogward | 74/56 X |

*Primary Examiner*—Peter Nerbun

*Attorney, Agent, or Firm*—Michael J. Striker

[57] ABSTRACT

Patterned stitching is produced by shifting the needle or work feed of the machine to different position coordinates. A motion-generating cam generates motion in a first path of motion. A transmission lever receives this motion and transmits it to the stitch forming instrumentalities. Positioning members move in synchronism with main shaft rotation in a second path of motion which is parallel to the first, and in doing so passes through different position-coordinate settings. Locking levers are activatable and releasable by solenoids for locking the positioning members in selected position-coordinate settings. A pattern-selecting unit operates in synchronism with main shaft rotation and selects the position-coordinate settings in which the positioning members are to be locked, and causes the locking levers to lock them in such settings.

18 Claims, 17 Drawing Figures

SEWING MACHINE WITH A PATTERN GENERATING DEVICE

BRIEF DESCRIPTION OF THE INVENTION

The present invention relates to a sewing machine, and more particularly relates to a pattern generating device for a sewing machine which generates various stitch patterns defined by various zigzag amplitudes and feeding amounts in response to electric control signals, and which is also composed of a few input-output instruments of a reduced size.

In this respect, the prior art in this field has been employing many bulky input-output instruments for effecting zigzag amplitudes and feeding amount proper to make continuous curved stitches in a pattern. Such many and bulky instruments have disadvantages such as causing vibrations and noises as well as occupying a wide space within a limited place of the sewing machine.

This invention has been devised to remove these disadvantages in the prior art.

It is a second object of the invention to provide a pattern generating device of compact and effective structure operated with little vibrations and noises.

It is a third object of the invention to provide a pattern generating device which is positively driven by selectively applied electric signals to produce predetermined stitch patterns.

It is a fourth object of the invention to provide a reliable pattern generating device which is normally operated to produce predetermined stitch patterns even by delayed or fast electric signals.

The other features and advantages of this invention will be apparent from the following description of the invention in reference to the attached drawings, in which, FIG. 1 shows a perspective view of a pattern generating device of a sewing machine in accordance with the invention, FIG. 2 shows a part of the invention partly disassembled, FIG. 3 shows another part of the invention, FIG. 4 shows a side elevational view of this invention in one operation in connection with the needle bar structure, FIG. 5 shows a side elevational view of this invention in another operation in connection with the needle bar structure, FIG. 6 shows a side elevational view of the invention in connection with the feeding structure.

FIG. 7 shows the position coordinates of the stitch forming instrumentalities of the sewing machine provided by the operation of this invention, FIG. 8 shows the position coordinates of the stitch forming instrumentalities of the sewing machine provided by another embodiment of this invention, FIGS. 9 - 15 shows the operations of this invention providing seven position coordinates of the stitch forming instrumentalities of a sewing machine, FIG. 16 shows a principle of this invention providing so many position coordinates of the stitch forming instrumentalities of a sewing machine, and FIG. 17 shows a block diagram of electric control circuits driving control signals to the device of this invention.

DETAILED DESCRIPTION OF THE INVENTION

Figure 1:
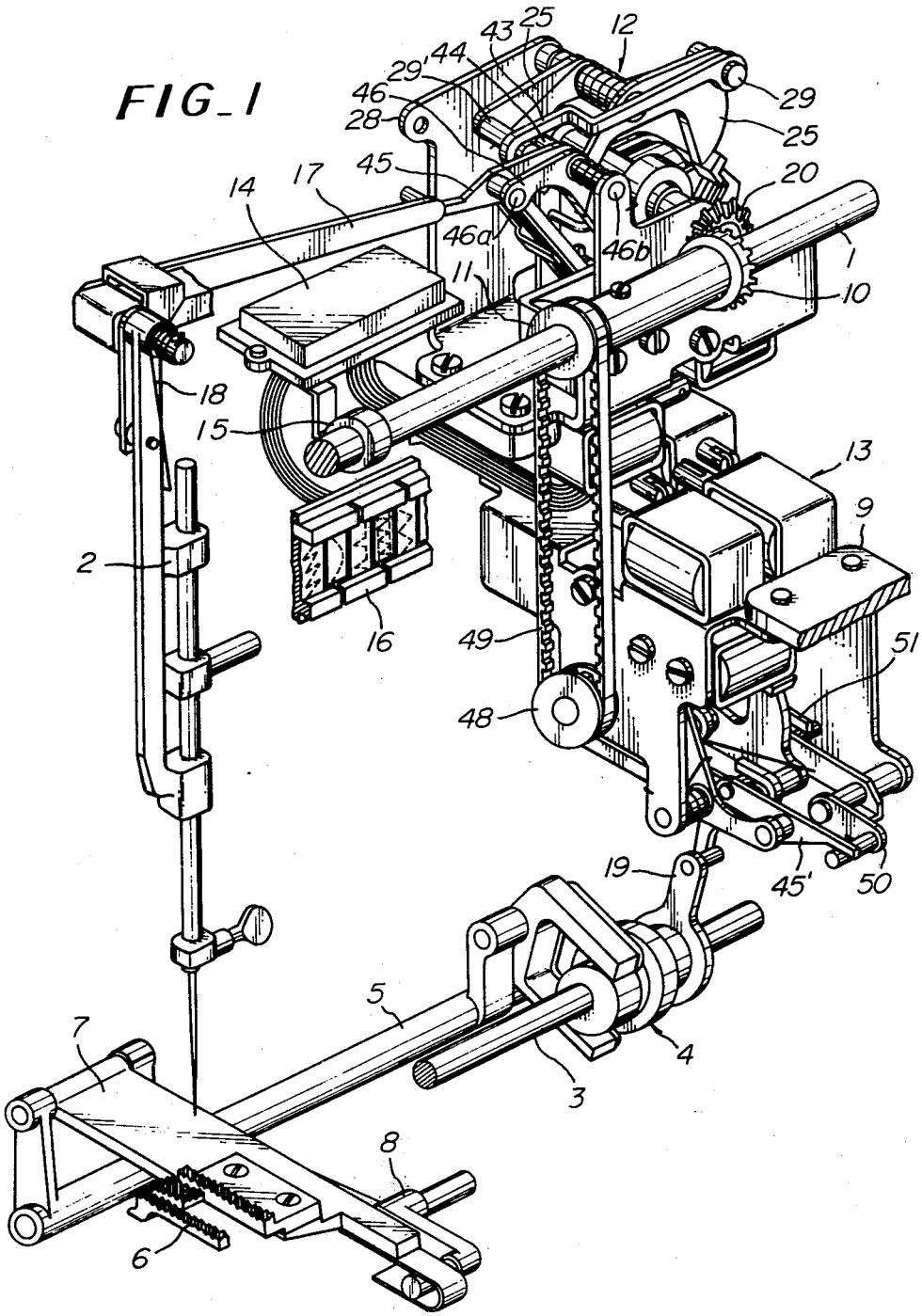

In FIG. 1 there are as shown arranged in a machine housing 9 although it is only partly illustrated, a main shaft 1 rotatably journalled in the machine housing, a swingable needle bar mechanism 2 including a needle bar operatively connected to the main shaft and vertically reciprocated thereby, a lower shaft 3 for driving a loop taker (not shown), a cloth feed adjusting mechanism 4 mounted on the lower shaft, a rocker shaft 5, a feed base 7 supporting a feed dog 6 and operatively connected to the rocker shaft so that the feed dog may be reciprocated in the horizontal plane by the rocker shaft 5, and a rocker arm 8 operatively connected to the feed dog to give the same a rocking movement. A gear 10 and a belt wheel 11 are fixedly mounted on the main shaft 1.

There are also arranged a needle position control device 12, a cloth feed control device 13, a pulse generator 15 mounted on the main shaft 1 for rotation therewith, and a control circuit 14 including a memory storing stitch control signals and operatively connected to the pulse generator. On the outside of the machine housing 9 there are arranged a plurality of pattern selecting switches 16 representing various stitching patterns.

With such an arrangement of the constituent members and devices, a selected electric signal through a predetermined order actuates the needle position control device 12 and the feed control device 13 and then the movements of the needle bar mechanism and the feed dog 6 are regululated through an actuating lever 17 and an adjusting lever 19 respectively, and a selected pattern is stitched.

Figure 2:
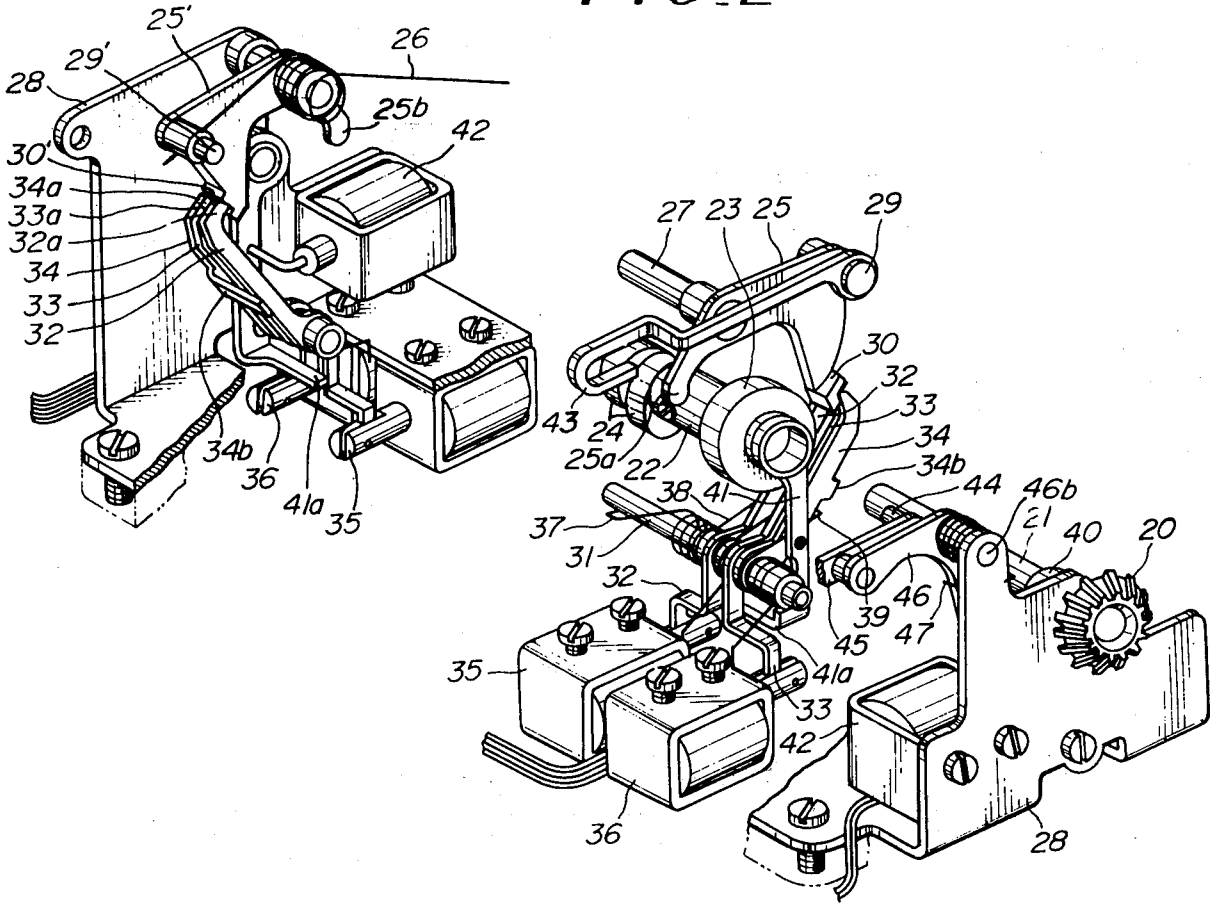

In FIG. 2, the needle position control device 12 is supported on a U-shaped support 28 secured to the machine housing 9. A cam shaft 21 is rotatably supported on the support 28. The cam shaft has at one end thereof a bevel gear 20 which is in mesh with the gear 10 on the main shaft 1. The cam shaft has also a cam body 22 secured thereto for rotation therewith. The cam body is provided with a cam 23, and cams 24, 24 which are of the same configuration and are located each in a different angular position.

A pair of needle positioning members 25, 25' are turnably mounted on a shaft 27 secured to the support 28 in a symmetrical fashion on both sides of the shaft 27 as shown. These needle positioning members 25, 25' are spring loaded. Namely the member 25 is biased in the counter clockwise direction by one end of a torsion spring 26, and the member 25' is biased in the clockwise direction by the other end of the forsion spring 26. One end **25*a* of the needle positioning member 25 engages one of the cams 24 while one end 25*b* of the needle positioning member 25' engages the other of the cams 24. As shown, the other ends of the needle positioning members 25, 25' are provided with engaging parts 30, 30'** respectively.

Figure 5:
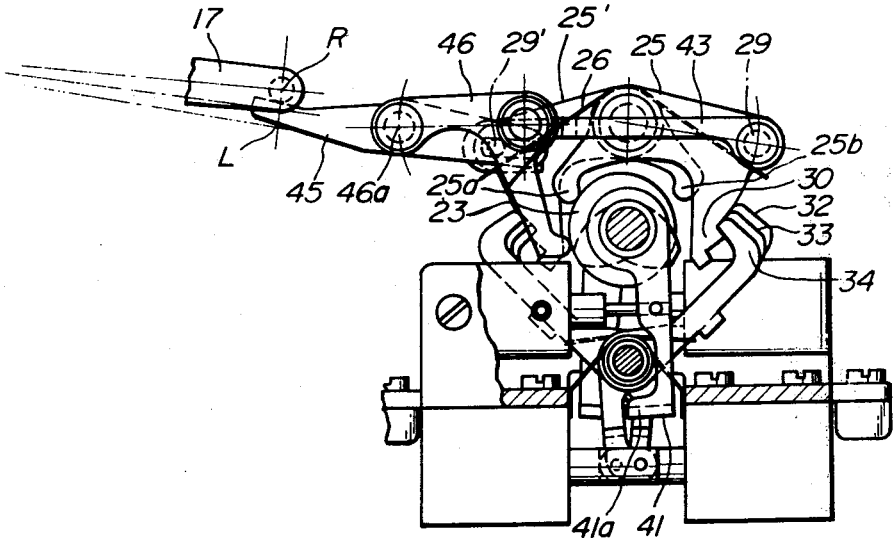
Figure 4:
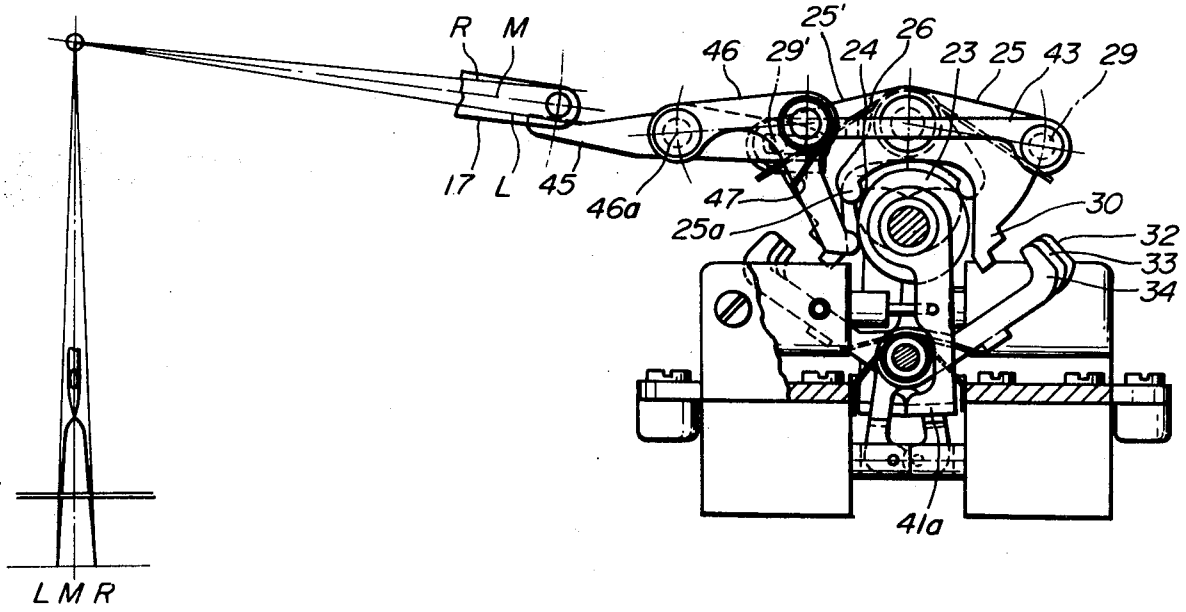

Locking levers 32, 33, 34 are turnably mounted on a shaft 31 secured to the support 28. These levers are respectively biased in one direction by springs 37, 38, 39, so that the pawls **32*a*, 33*a*, 34*a*) at the free ends of the locking levers extending on one side of the shaft 31 may cooperate with the engaging part 30 of the needle positioning member 25 in engagement with and/or in disengagement from the engaging part 30. The levers 32, 33 of the three levers are connected to solenoids 35, 36** which are fixed to the support 28 and operated by an electric control signal selected at the pattern selecting switches 16. The other locking lever 34 has a bent arm **34*b* which is pressed against the levers 32, 33, so that the lever 34 may be operated by the solenoids 35, 36 through the levers 32, 33. These locking levers 32, 33, 34 are, as shown in FIGS. 4 and 5, so arranged as to cooperate with the engaging part 30 of the member 25** each in a different position.

A lever 41 is at its one end mounted on a bearing 40 on the shaft 21, and is operatively connected to a solenoid 42, so that the lever may be electrically operated by the solenoid. The lever 41 has a bent extension **41*a* at the other end thereof which is pressed against the lever parts of the locking levers 32, 33 which are connected to the solenoids 35, 36 respectively. Thus the lever 41 acts as a stopper for limiting the movement of the locking levers 32, 33**.

Now a half part of the needle position control device 12 has been described. The other half of the needle position control device 12 is composed of the same combination of parts as that of the aforementioned half as illustrated in FIGS. 2, 4 and 5, including the needle positioning member 25'; the same number of spring biased locking levers which are turnably mounted on the same shaft 31 and extending to the member 25' on the other side of the shaft 31, of which two locking levers are operatively connected to the respective solenoids and the other locking lever is operated by the solenoids through the two locking levers in the same manner as in the opposite half of the device 12; and a lever corresponding to the lever 41 mounted on the shaft 21 and operatively connected to the other one solenoid for limiting the movement of the locking levers.

Thus it will be easily understood that the needle position control device 12 consists of two symmetrically arranged halves of the same combination of parts. In reference to FIGS. 1, 2 and 4, the needle position member 25 is connected to one end of a link 43 by means of a pin 29, and the other needle portion member 25' is connected to the bent position at the other end of the link 43 by means of a pin 29'. A holder lever 46 is turnably mounted on a shaft **46*b* secured to the support 28. The holder lever 46 is biased in the counterclockwise direction by a torsion spring 47, so that one end of the holder lever may engage the cam 23 of the cam body 22 on the shaft 21. The other end of the holder lever 46 supports a pin 46*a*. A transmission lever 45 is at the intermediate part thereof turnably mounted on the pin 46*a*, and supports a pin 44 on one end thereof which is connected to the bent end of the link 43. The other end of the transmission lever 45 is connected to one end of the operating lever 17, the other end of which is operatively connected to the swingable needle bar mechanism 2. Thus the shaft 21 of the needle position control device 12 is rotated in the same speed with the main shaft 1 of the sewing machine, and the swinging movement of the needle positioning members 25, 25' is transmitted to the needle bar mechanism 2 through the link 43, transmission lever 45 and the operating lever 17, and the position of the support axis 46*a* is variously shifted by the cam 23**.

Figure 3:
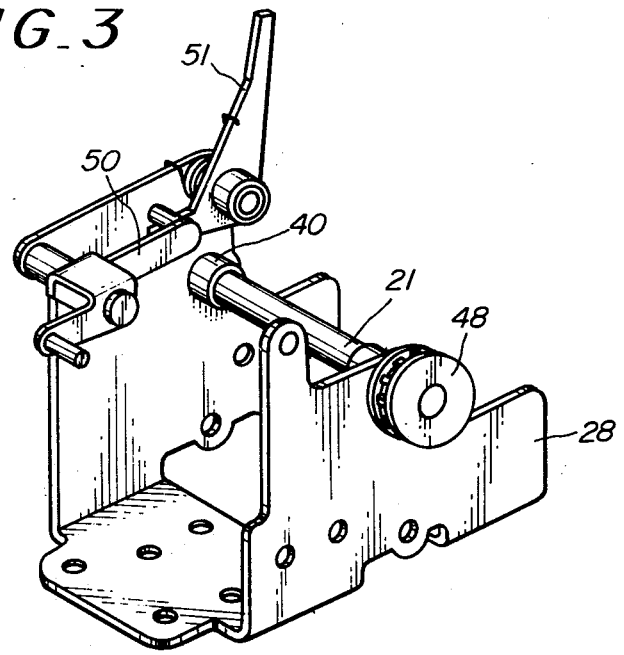
Figure 6:
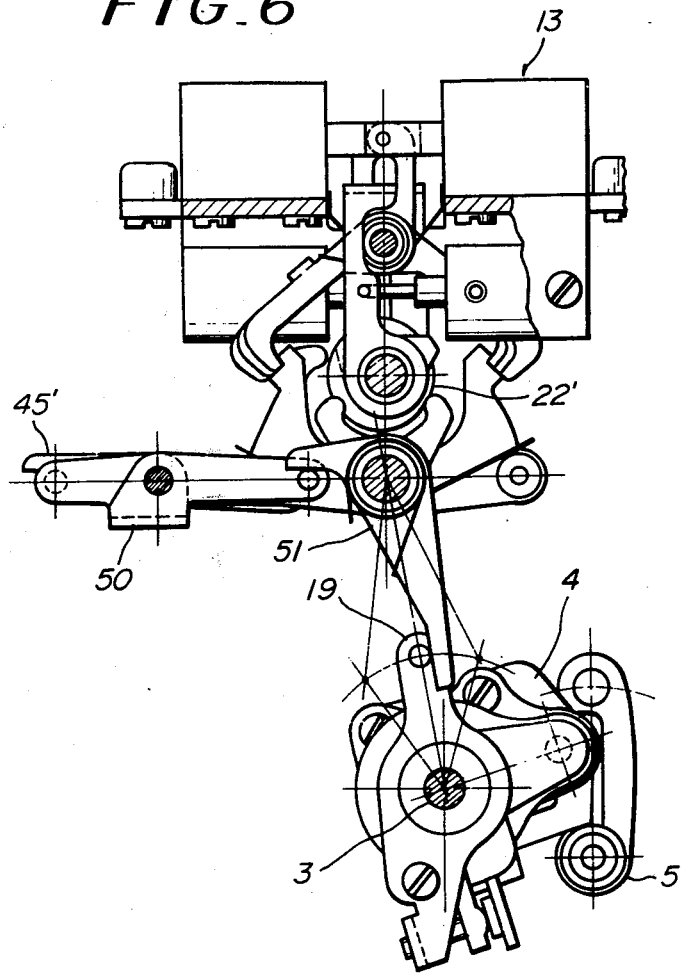

In FIGS. 3 and 6, the feed control device 13 is substantially of the same structure as that of the needle position control device 12. The drive shaft of the feed control device 13, which corresponds to the shaft 21 of the needle position control device 12, has a belt wheel 48 secured to one end thereof. The belt wheel 48 is connected to the belt wheel 11 on the main shaft 1 by means of a timing belt 49, so that the drive shaft of the feed control device 13 may be driven in the same speed with the main shaft. The swinging movement of the members of the feed control device 13 corresponding to the members 25, 25' is transmitted to the operating arm 19 of the feed adjusting mechanism 4 through the transmission lever 45', a swinging lever 50 turnably mounted on the support 28 and a rocker arm 51 as shown. Thus the feeding amplitude and the feeding direction of the feed dog 6 are varied.

The needle positioning movement of the needle position control device 12 is as follows: the cams 24, 24 of the cam body 22 on the shaft 21, which is rotated in the same speed with the main shaft (1), swing the needle positioning members 25, 25' against the action of the torsion spring 6 to the lowest position which corresponds to R position of the needle, and after a pause, the torsion spring 6 swings the needle positioning members 25, 25' back to the highest position which corresponds to L position of the needle as shown in FIGS. 4 and 5. Such a swinging movement of the needle positioning members is repeated during the rotation of the main shaft 1 of the sewing machine. The cams 24, 24 are ineffective while the needle remains in the sewn work. When the needle positioning members 25, 25' are swung to the highest position, in other words, when the ends **25*a*, 25*b* of the members 25, 25' are swung to the lowest position, any of the pawls 32*a*, 33*a*, 34*a* of the locking levers 32, 33, 34 are in the course of being released from the engaging parts 30, 30' of the needle positioning members 25, 25' respectively by the associated solenoids 35, 36, 42 which are selectively energized from the stitch control circuit 4 including the memory. When the needle positioning members 25, 25' are swung to the lowest position, in other words, when the ends 25*a*, 25*b* of the members 25, 25' are swung to the highest position, any of the pawls 32*a*, 33*a*, 34*a* of the spring loaded locking levers 32, 33, 34 are in the course of engaging the engaging parts 30, 30' of the members 25, 25' respectively by the action of the associated solenoids 35, 36, 42 which are selectively deenergized. Namely these locking levers each act as so many stoppers for the needle positioning members 25, 25', and maintain the needle position coordinate pins 29, 29', connecting the members 25, 25' to the link 43, in a determined position. Thus the swinging movement of the needle positioning members 25, 25' is transmitted to the operating lever 17 through the link 43 and the transmission lever 45** and the needle position is determined.

In reference to FIGS. 4 and 5, since the largest swinging amplitude of the needle positioning members 25, 25', which take a pause while the needle is at the upper dead point thereof, gets over a position corresponding to the R position of the needle so as to make a positive engagement between the engaging parts 30, 30' of the members 25, 25' and the respective locking levers which determine the R position of the needle, the needle is necessarily swung above the sewn work in an amplitude larger than the predetermined largest width (L-R) of the swinging movement of the needle in order that the needle is dropped to the positions R and L. Namely the needle must be shifted in a wider range at the time the needle descends and at the time the needle ascends. Such a shift of the needle becomes a cause of irregular stitches and also it is mechanically undesirable.

For the purpose of properly shifting the needle in one reciprocation thereof, the cam 23 of the cam body 22 on the shaft 21 turns the holder lever 46 and displaces the pivot pin 46*a* of the holder lever 46 on which the transmission lever 45 is mounted, so that the transmission lever 45 may transmit the swinging movement of the needle positioning members 25, 25', which corresponds to the needle position setting over the R position, to the operating lever 17 in such a manner that the needle will take a position M above the sewn work. The cam 23 operates to return the pivot pin 46*a* of the holder lever 46 to it original position before the needle positioning members 25, 25' take a normal or correct position corresponding to the needle position R, and before the needle penetrates the sewn work. Thus the combined movement of the needle of swinging and vertical reciprocations is made in a natural movement path, and also the action of the spring 18 to the control device is normalised.

As illustrated in FIGS. 1 and 6, the operating movement of the feed control device 13 is the same with that of the needle position control device 12. The operating movement of the feed control device 13 is transmitted via the transmission lever 45', the swing lever 50 and the rocker arm 51 to the adjusting lever 19 of the feed adjusting mechanism 4 which is mounted on the lower shaft 3 and the rocker shaft 5. In this case, the feed control device 13 is operated in a phase difference 180° of the rotation of the main shaft 1 relative to the needle position control device 12. Namely the cam body 22' is rotated in a phase difference of 180° relative to the cam body 22 of the needle position control device 12, and the electric signals are supplied to the solenoids of the feed control device 13 in a phase difference of 180° relative to those of the needle position control device 12. Thus the feed control device 13 controls the operating movement of the feed adjusting mechanism 4 in proportion to the work feeding pitched in the forward and reverse directions from the feed stop position.

Figure 7:
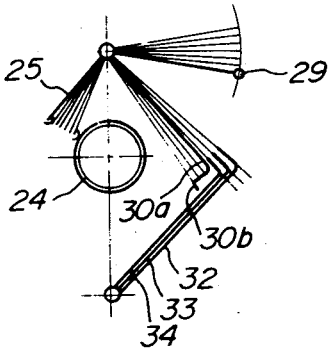
Figure 8:
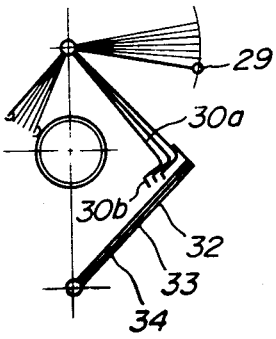

In FIGS. 2 and 4, particularly in FIGS. 7 and 8, the engaging parts 30, 30' of the needle positioning members 25, 25' are respectively provided with two stepped engaging faces 30*a*, 30*b*. The pawls 32*a*, 33*a*, 34*a* of the locking levers 32, 33 34 are each adapted to selectively engage the engaging face 30*a* and the engaging face 30*b*. Therefore, with the combination of the engaging faces 30*a*, 30*b* and the three locking levers 32, 33, 34, six needle position coordinates can be obtained on one needle positioning member 25 or 25'. One additional needle position coordinate can be obtained on one needle position member by the engagement between the needle positioning member and one of the cams 24, 24 on the cam body 22 while the locking levers 32, 33, 34 are spaced from any of the engaging faces. Thus the needle position coordinates obtained on the needle positioning member are seven in all.

FIG. 8 shows another embodiment of the invention in which the pawls 32*a*, 33*a*, 34*a* of the locking levers 32, 33, 34 are aligned at a single level, and the engaging faces 30*a*, 30*b* of the needle positioning member are stepped relative to the respective pawls, so as to obtain same number of needle position coordinates with the number of needle position coordinates obtained in FIG. 7.

FIGS. 9–15 show the relations between the locking levers 32, 33, 34 and the engaging faces 30*a*, 30*b* of one needle positioning member 25 to determine the seven needle position coordinates. As aforementioned, the locking levers 32, 33 are connected to the solenoids 35, 36 respectively and are operated by electric signals applied to the solenoids 35, 36. The other lever 34 is at its bent portion 34*b* connected to the levers 32, 33, and is operated when one of the levers 32, 33 is operated or when both levers 32, 33 are operated by the respectively associated solenoids. In those Figures, one of the locking levers 32, 33, 34, which has no relation with the limiting lever 41 selectively operated by an electric signal applied to the solenoid 42, engages the engaging face 30*a* of the needle positioning member 25 due to the action of the loaded spring. The engaging face 30*b* can be engaged by the locking levers when the movement of these levers is limited by half by the limiting lever 41. These levers 32, 33, 34 are disengaged from the engaging faces 30*a*, 30*b* by the energized solenoid respectively. The electric signals are given or become null to the solenoids 35, 36, 42 to selectively operate the associated locking levers while the needle reaches to the upper dead point thereof from a point where it is clear of the sewn work.

Even if the electric signals are given to the solenoids while the needle is in the sewn work, it gives no adverse influence to the formation of predetermined stitches, because, as aforementioned, the engaging parts 30, 30' of the needle positioning members 25, 25', which are swung by the respective cams 24, 24 in synchronism with the vertical reciprocation of the needle, disengage from any of the locking levers during the turning movement in the lower direction, and because the engaging parts 30, 30' are engaged and held in a predetermined position by the selected one of the locking levers during the turning movement in the upper direction when the members 25, 25' are freed from the respective cams 24, 24. Namely, none of the locking levers can disengage from the engaging parts 30, 30' if the respective solenoid is energized, due to the frictional engagement therebetween by means of the torsion spring 26 until the members 25, 25' are swung in the lower direction by the respective cams 24, 24.

On the other hand, if the electric signals become null to the solenoids while the needle is in the sewn work, it gives no adverse influence to the formation of predetermined stitches, because any of the locking levers can not engage the engaging parts 30, 30' until the previously selected one of the locking levers is freed from the engaging parts 30, 30' of the needle positioning members 25, 25'.

Figure 9:
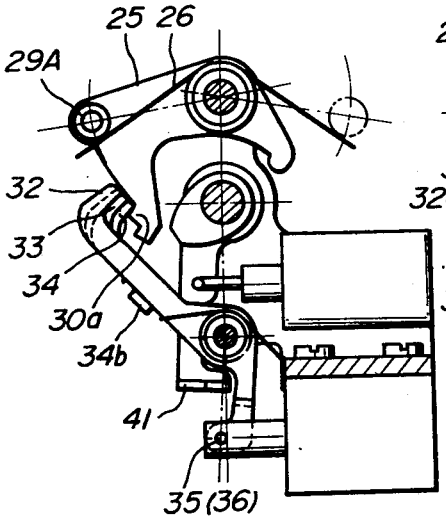
Figure 10:
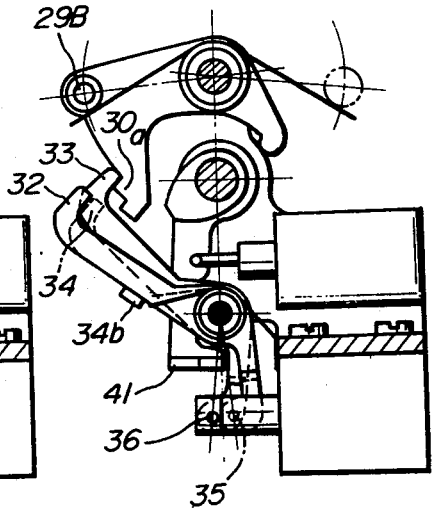
Figure 11:
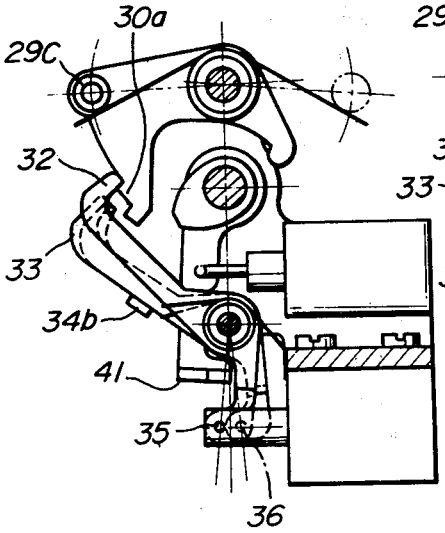
Figure 12:
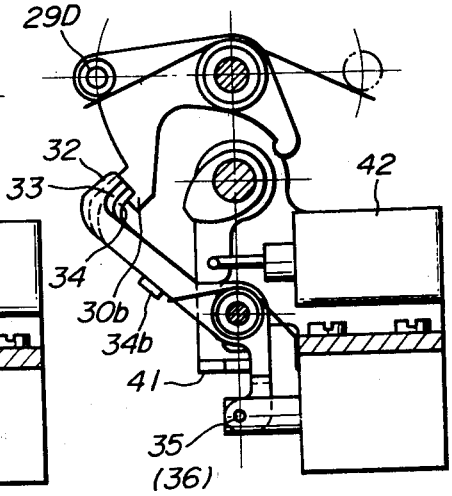
Figure 13:
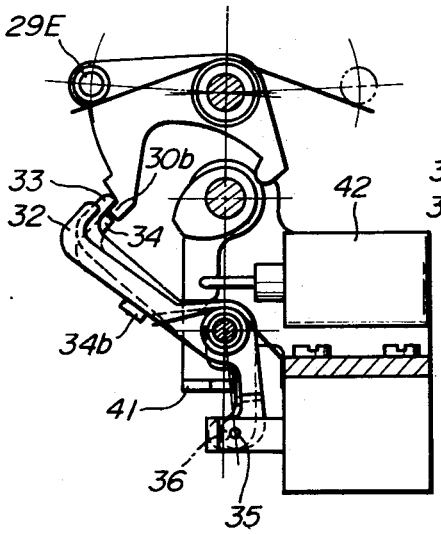
Figure 14:
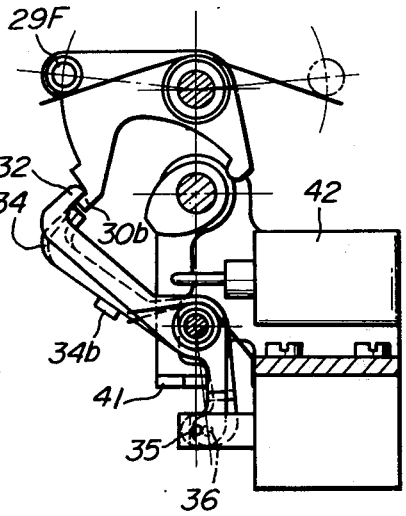
Figure 15:
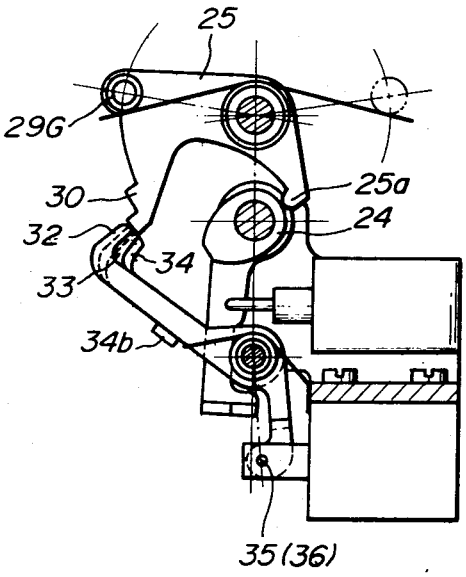

FIG. 9 shows the selection of a needle position coordinate 29A, in which none of the solenoids is energized, and the locking lever 34 engages the engaging face 30*a* of the needle positioning member 25. FIG. 10 shows the selection of a needle position coordinate 29B, in which the solenoid 35 is energized to locate the locking levers 32, 34 in a position spaced from the engaging part 30 of the member 25 and the locking lever 33 engages the engaging part 30*a*. FIG. 11 shows the selection of a needle position coordinate 29C, in which the solenoid 36 is energized to locate the locking levers 33, 34 in a position spaced from the engaging part 30 of the needle positioning member 25 and the locking lever 32 engages the engaging face 30*a*. FIG. 12 shows the selection of a needle position coordinate 29D, in which the solenoid 42 is energized to operate the limiting lever 41 to limit the movement of the locking levers 32, 33, 34 in the half; the solenoids 35, 36 are not energized and the locking lever 34 engages the engaging face 30*b* of the needle positioning member 25. FIG. 13 shows the selection of a needle position coordinate 29E, in which the solenoid 42 is energized to make the same effect as in FIG. 12; the solenoid 35 is energized to locate the locking levers 32, 34 in a position spaced from the engaging part 30 of the needle positioning member 25 and the locking lever 33 engages the engaging face 30*b*. FIG. 14 shows the selection of a needle position coordinate 29F, in which the solenoid 42 is energized to obtain the same effect as in FIG. 12 or 13; the solenoid 36 is energized to locate the locking levers 33, 34 in a position spaced from the engaging part 30 of the needle positioning member 25 and the locking lever 32 engages the engaging face 30*b*, and FIG. 15 shows the selection of a needle position coordinate 29G, in which the solenoids 35, 36 are energized to locate the locking levers 32, 33, 34 to the inoperative positions respectively, and the needle positioning member 25 is brought to a position predetermined by the cam 24.

Figure 16:
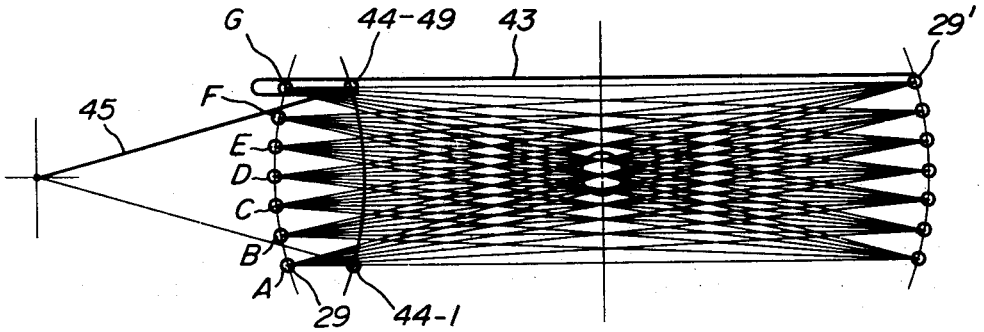

In the present invention, since the needle position coordinating pins 29, 29' are provided in symmetry on both sides of the shaft 27, the all needle position coordinates determined by the locking levers and the cams 24, 24 on both sides of the shaft 27 can be connected to each other in various combinations by the link 43. Thus 49 position coordinates can be obtained each for the needle and for the feed dog 6 as shown in FIG. 16. The connecting pin 44 of the transmission lever 45 engages the end of the link 43 at a position for transmitting the position coordinates with an equal space therebetween each to the adjacent other, to the needle and to the feed dog.

Figure 17:
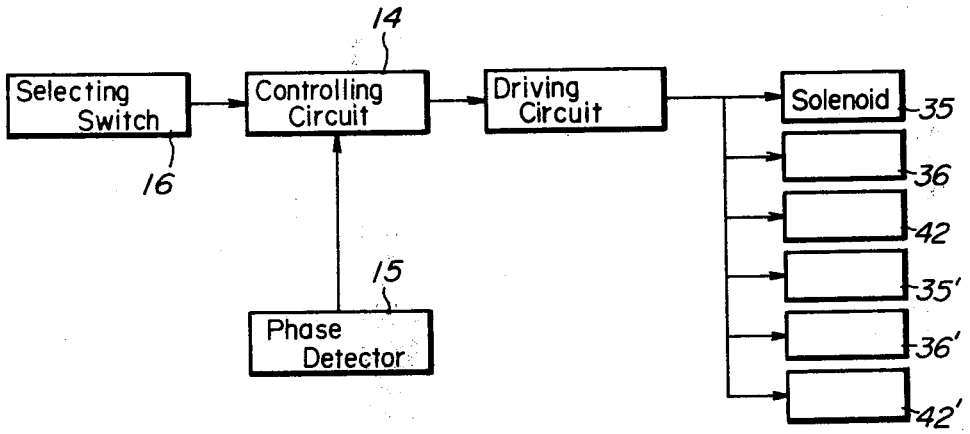

FIG. 17 shows a block diagram for passing an electric signal to the solenoids 35, 36, 42, 35', 36', 42' for the needle position control device 12 and the feed control device 13 respectively. Namely when one of the selecting switches 16 is operated, an electric signal is transmitted to the control circuit including the memory. Then, after receiving a timing pulse from the pulse generator 15, the control circuit issues a signal to the driving circuit which transmit the signal to the selected one or ones of the solenoids.

We claim:

1. In a sewing machine having a machine housing, a main shaft rotatably journaled in the machine housing, stitch forming instrumentalities movable to different positions defined by different respective position coordinates for changing the relative position between the needle and the sewn work in order to form stitches in a pattern, in combination, motion-generating means operative in synchronism with main shaft rotation for generating motion in a first path of motion; transmission means connected to the motion-generating means and to the stitch forming instumentalities and operative for moving the latter to different positions defined by different respective position coordinates by receiving the motion generated by the motion-generating means and transmitting such motion to the stitch forming instrumentalities; positioning means connected to the motion-generating means and to the transmission means and operative in synchronism with main shaft rotation for performing motion in a second path of motion which is parallel to said first path of motion and in so doing moving through a plurality of different position-coordinate settings which establish the different position coordinates for the stitch forming instrumentalities; electrically activatable and releasable locking means for locking the positioning means in different ones of said position-coordinate settings; and pattern-selecting means connected to the locking means and operative in synchronism with main shaft rotation for selecting the position-coordinate settings in which the positioning means is to be locked and causing the locking means to lock the positioning means in such settings.

2. A sewing machine as defined in claim 1, wherein the positioning means comprises a pair of symmetrically arranged positioning members each having an engaging part and a cam follower; wherein the locking means comprises a plurality of levers movable between locking position each engaging the engaging parts of the positioning members respectively and released position disengaged from the engaging parts; and solenoids each operatively connected to the locking levers and energized to move the locking levers from the locking position to the released position.

3. A sewing machine as defined in claim 2, including springs each normally biasing the locking levers to the locking position.

4. A sewing machine having a machine housing, a main shaft rotatably journalled in the machine housing, stitch forming instrumentalities for changing relative positions of the needle and the sewn work to form stitches in a pattern, and a pattern generating device operatively connected to the stitch forming instrumentalities, the pattern generating device comprising positioning means operated in synchronism with the rotation of the main shaft to control the position coordinates of the stitch forming instrumentalities; locking means movable between an effective position for locking the positioning means at a predetermined position and an ineffective position for releasing the positioning means; means for moving the locking means to the effective position; means electrically operated to move the locking means to the ineffective position; and pattern selecting means selectively operated to issue an electric signal for controlling the operation of the electrically operated means, wherein the positioning means comprises a pair of symmetrically arranged positioning members each having an engaging part and a cam follower; wherein the locking means comprises a plurality of levers movable between the effective position each engaging the engaging parts of the positioning members respectively and the ineffective position disengaged from the engaging parts; and wherein the electrically operated means comprises solenoids each operatively connected to the locking levers and energized to move the locking levers from the effective position to the ineffective position, further comprising a connecting link and a transmission lever; wherein the positioning members are each provided with a pin for determining the position coordinates of the stitch forming instrumentalities, the pins of the positioning members being connected by the connecting link and operatively connected to the stitch forming instrumentalities via the transmission lever.

5. A sewing machine as defined in claim 4, wherein the transmission lever is swingably supported on a pivot and is at one end thereof operatively connected to the connecting link and at the other end thereof operatively connected to the stitch forming instrumentalities.

6. A sewing machine as defined in claim 5 further comprising a device for displacing the pivot in synchronism with the rotation of the main shaft so as to facilitate the engagement and disengagement between the locking levers and the engaging parts of the positioning members in the maximum swinging movement of the positioning members in one direction, the device comprising a further cam rotated in the same speed with the main shaft and a lever swingably mounted on an axis and at one end thereof in engagement with the further cam and at the other end thereof connected to the pivot.

7. A sewing machine having a machine housing, a main shaft rotatably journalled in the machine housing, stitch forming instrumentalities for changing relative positions of the needle and the sewn work to form stitches in a pattern, and a pattern generating device operatively connected to the stitch forming instrumentalities, the pattern generating device comprising positioning means operated in synchronism with the rotation of the main shaft to control the position coordinates of the stitch forming instrumentalities; locking means movable between an effective position for locking the positioning means at a predetermined position and an ineffective position for releasing the positioning means; means for moving the locking means to the effective position; means electrically operated to move the locking means to the ineffective position; and pattern selecting means selectively operated to issue an electric signal for controlling the operation of the electrically operated means, wherein the positioning means comprises a pair of symmetrically arranged positioning members each having an engaging part and a cam follower; wherein the locking means comprises a plurality of levers movable between the effective position each engaging the engaging parts of the positioning members respectively and the ineffective position disengaged from the engaging parts; and wherein the electrically operated means comprises solenoids each operatively connected to the locking levers and energized to move the locking levers from the effective position to the ineffective position, further comprising cams rotated in the same speed with the effective position of the main shaft and engaging the cam followers of the positioning members to operate the positioning members in synchronism with the rotation of the main shaft.

8. A sewing machine having a machine housing, a main shaft rotatably journalled in the machine housing, stitch forming instrumentalities for changing relative positions of the needle and the sewn work to form stitches in a pattern, and a pattern generating device operatively connected to the stitch forming instrumentalities, the pattern generating device comprising positioning means operated in synchronism with the rotation of the main shaft to control the position coordinates of the stitch forming instrumentalities; locking means movable between an effective position for locking the positioning means at a predetermined position and an ineffective position for releasing the positioning means; means for moving the locking means to the effective position; means electrically operated to move the locking means to the ineffective position; and pattern selecting means selectively operated to issue an electric signal for controlling the operation of the electrically operated means, wherein the positioning means comprises a pair of symmetrically arranged positioning members each having an engaging part and a cam follower; wherein the locking means comprises a plurality of levers movable between the effective position each engaging the engaging parts of the positioning members respectively and the ineffective position disengaged from the engaging parts; and wherein the electrically operated means comprises solenoids each operatively connected to the locking levers and energized to move the locking levers from the effective position to the ineffective position, wherein the positioning members are swingably mounted on a common shaft and spring biased so that the cam followers of the positioning members may engage the cams respectively; and wherein the locking levers are turnably mounted on a common shaft and are respectively provided with pawls engaging the engaging parts of the positioning members to hold the positioning members at a predetermined position so as to determine a position coordinate of the stitch forming instrumentalities.

9. A sewing machine having a machine housing, a main shaft rotatably journalled in the machine housing, stitch forming instrumentalities for changing relative positions of the needle and the sewn work to form stitches in a pattern, and a pattern generating device operatively connected to the stitch forming instrumentalities, the pattern generating device comprising positioning means operated in synchronism with the rotation of the main shaft to control the position coordinates of the stitch forming instrumentalities; locking means movable between an effective position for locking the positioning means at a predetermined position and an ineffective position for releasing the positioning means; means for moving the locking means to the effective position; means electrically operated to move the locking means to the ineffective position; and pattern selecting means selectively operated to issue an electric signal for controlling the operation of the electrically operated means, wherein the positioning means comprises a pair of symmetrically arranged positioning members each having an engaging part and a cam follower; wherein the locking means comprises a plurality of levers movable between the effective position each engaging the engaging parts of the positioning members respectively and the ineffective position disengaged from the engaging parts; and wherein the electrically operated means comprises solenoids each operatively connected to the locking levers and energized to move the locking levers from the effective position to the ineffective position, wherein the locking means comprises three levers, two of which connected to the corresponding solenoids and the other lever operatively connected to the two levers so that the lever may be operated in association with one or all of the two levers.

10. A sewing machine as defined in claim 9, further comprising a lever operatively connected to an additional solenoid to limit the movement of the locking levers when the additional solenoid is energized.

11. A sewing machine having a machine housing, a main shaft rotatably journalled in the machine housing, stitch forming instrumentalities operatively connected to the main shaft and changing relative positions of the needle and the sewn work to form stitches in a pattern and a pattern generating device operatively connected to the main shaft and the stitch forming instrumentalities, the pattern generating device comprising positioning means including a pair of positioning members spaced from each other and each having an engaging part and a cam follower, and operated in synchronism with rotation of the main shaft; locking means including a plurality of levers movable between an effective position in which each of the levers engages the engaging parts of the positioning members to lock the same in a predetermined position and an ineffective position in which each of the levers disengages from the engaging parts; means for moving the locking levers to the effective positions respectively; electromagnetic means including a plurality of solenoids each operatively connected to the locking levers and energized to move the same time from the effective positions to the ineffective positions; pattern selecting means including a plurality of switches manually and selectively operated to issue an electric signal for controlling the operation of the solenoids; a link connecting the pair of said positioning members; and a transmission lever having one end connected to the connecting link and the other end operatively connected to the stitch forming instrumentalities.

12. A sewing machine as defined in claim 11, wherein the pair of positioning members are each provided with a pin for determining the position coordinates of the stitch forming instrumentalities; and wherein the connecting link connects the pin on one of the positioning members and the pin on the other of the positioning members.

13. A sewing machine as defined in claim 11, further comprising cams rotated at the same speed with rotation of the main shaft and engaging corresponding cam followers on the positioning members to operate the positioning members is synchronism with rotation of the main shaft.

14. A sewing machine as defined in claim 11, wherein the positioning members are swingably mounted on a common shaft and spring biased so that the cam followers of the positioning members may engage the cams respectively; and wherein the locking levers are turnably mounted on a common shaft and are respectively provided with pawls engaging the engaging parts of the positioning members to hold the positioning members at predetermined positions so as to determine position coordinates for the stitch forming instrumentalities.

15. A sewing machine as defined in claim 11, wherein the locking means comprises three levers, two of which are connected to corresponding solenoids and the other lever operatively connected to the two levers so that the lever may be operated in association with one or both of the two levers.

16. A sewing machine as defined in claim 15, further comprising a lever operatively connected to an additional solenoid to limit the movement of the locking levers when the additional solenoid is energized.

17. A sewing machine as defined in claim 11, wherein the transmission lever is swingably supported on a pivot and is at one end thereof operatively connected to the connecting link and at the other end thereof operatively connected to the stitch forming instrumentalities.

18. A sewing machine as defined in claim 17, further comprising a device for displacing the pivot in synchronism with rotation of the main shaft so as to facilitate the engagement and disengagement between the locking levers and the engaging parts of the positioning members in the maximum swinging movement of the positioning members in one direction, the device comprising a cam rotated in the same speed with the main shaft and a lever swingably mounted on an axis and at one end thereof in engagement with the cam and at the other end thereof connected to the pivot.

* * * * *